US006266506B1

(12) United States Patent
Kurz et al.

(10) Patent No.: US 6,266,506 B1
(45) Date of Patent: Jul. 24, 2001

(54) MECHANICAL KEYING CONCEPT FOR REFILLABLE PRINT CARTRIDGE/TONER BOTTLE STRATEGY

(75) Inventors: Karl E. Kurz, Rochester; Daniel A. Chiesa; Tom W. Claessens, both of Webster, all of NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/408,809

(22) Filed: Sep. 29, 1999

(51) Int. Cl.[7] ..... G03G 15/08
(52) U.S. Cl. ..... 399/262; 399/12
(58) Field of Search ..... 399/12, 13, 24, 399/25, 27–29, 258, 266, 262

(56) References Cited

U.S. PATENT DOCUMENTS

| | | | | |
|---|---|---|---|---|
| 4,650,070 | | 3/1987 | Oka et al. | 206/216 |
| 4,963,939 | * | 10/1990 | Kurando et al. | 399/12 |
| 4,978,995 | * | 12/1990 | Takahashi | 399/12 |
| 5,074,344 | | 12/1991 | Vacek et al. | 141/363 |
| 5,075,724 | * | 12/1991 | Wada et al. | 399/12 |
| 5,089,854 | | 2/1992 | Kaieda et al. . | |
| 5,091,750 | | 2/1992 | Yoshida et al. . | |
| 5,150,162 | * | 9/1992 | Saito | 399/262 X |
| 5,150,807 | | 9/1992 | Seyfried et al. . | |
| 5,293,913 | * | 3/1994 | Preszler | 399/262 X |
| 5,331,382 | | 7/1994 | Miura et al. . | |
| 5,383,502 | | 1/1995 | Fisk et al. . | |
| 5,559,589 | | 9/1996 | Eichberger et al. . | |
| 5,615,001 | | 3/1997 | Kawashima et al. | 399/226 |
| 5,630,198 | | 5/1997 | Makino | 399/120 |
| 5,655,181 | | 8/1997 | Chandani et al. | 399/114 |
| 5,678,121 | | 10/1997 | Meetze, Jr. et al. | 399/12 |
| 5,734,953 | | 3/1998 | Tatsumo | 399/262 |
| 5,761,566 | * | 6/1998 | Suzuki et al. | 399/12 |
| 5,812,915 | | 9/1998 | Farkash | 399/262 |
| 5,848,338 | | 12/1998 | Okada | 399/262 |
| 5,857,129 | | 1/1999 | Harris | 399/12 |
| 6,006,046 | * | 12/1999 | MacFarland | 399/12 |

* cited by examiner

*Primary Examiner*—William J. Royer
(74) *Attorney, Agent, or Firm*—Kevin R. Kepner

(57) ABSTRACT

A container for delivering a supply of particles for use in a developer unit of an electrophotographic printing machine, the container being fittable to an adapter associated with the developer unit, the container includes a body defining a chamber for storing particles therein, the body defining an aperture in an end thereof and a cover for use in covering the aperture, wherein the cover includes a valve mechanism and a keying feature, wherein the keying feature cooperates with a portion of the developer unit so that upon rotation of the container, the valve mechanism is actuated.

6 Claims, 11 Drawing Sheets

FIG. 5
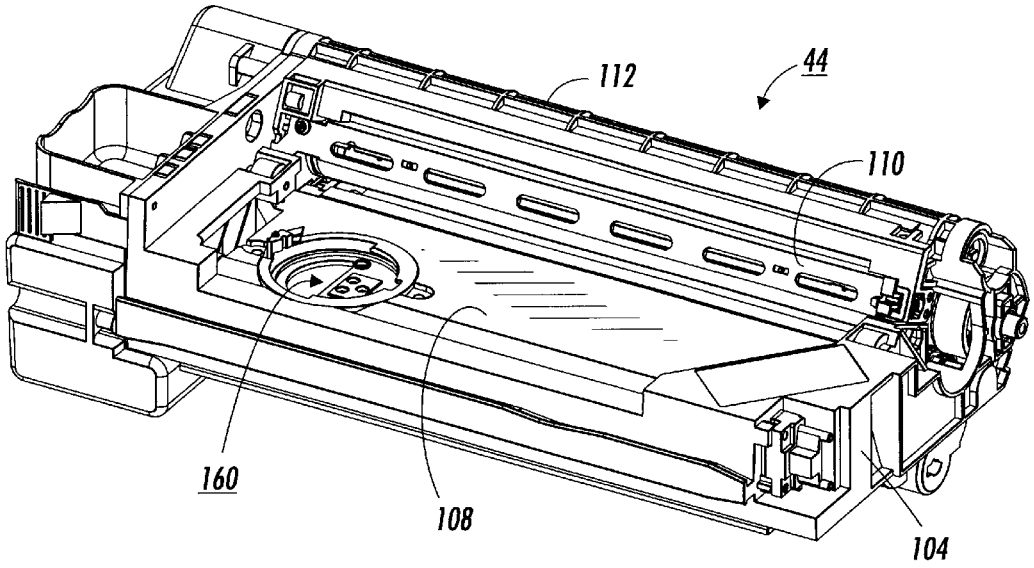
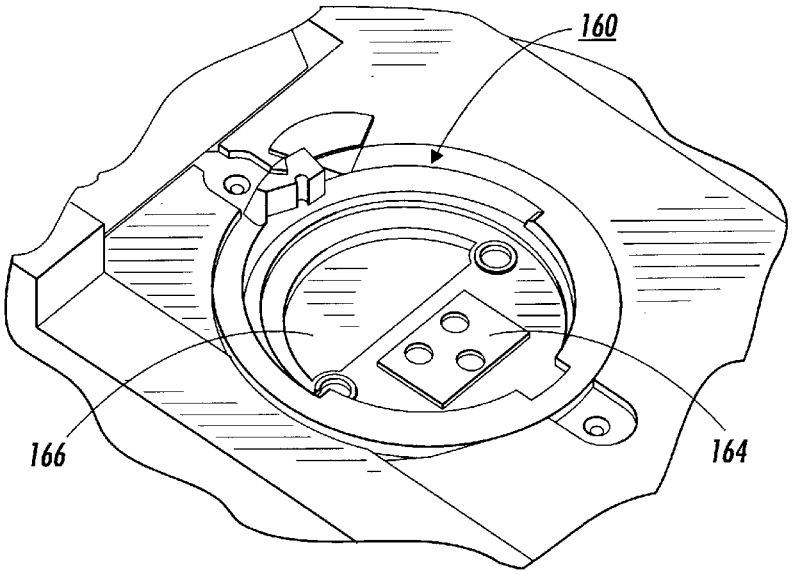
FIG. 6

FIG. 7
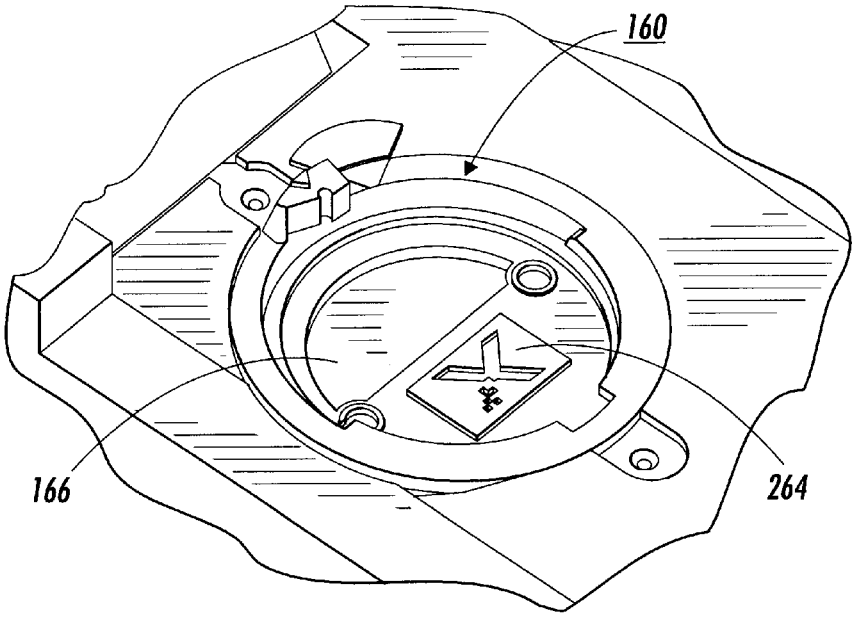
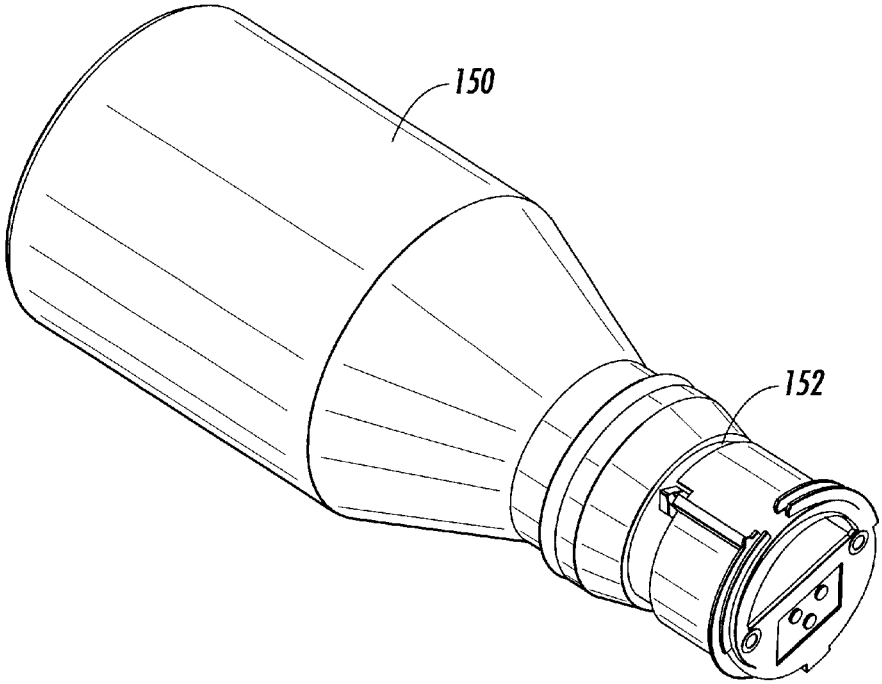
FIG. 8

FIG. 9
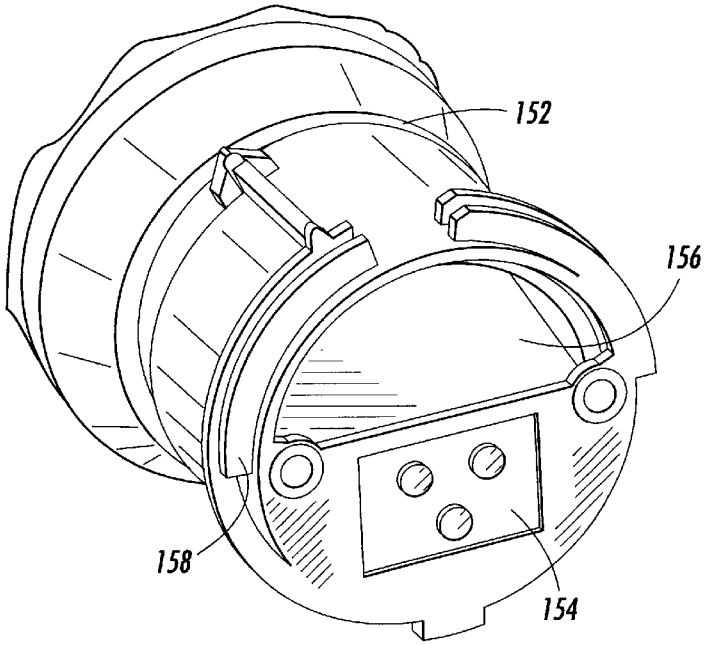
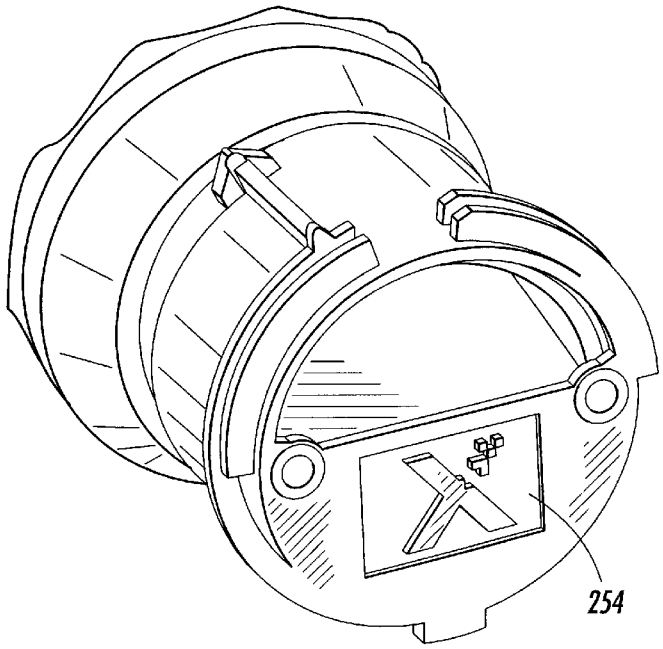
FIG. 10

FIG. 11
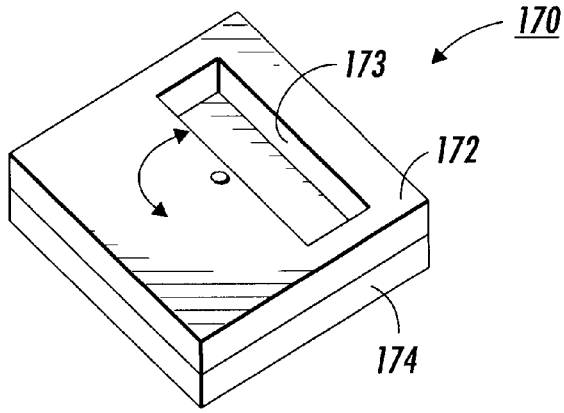
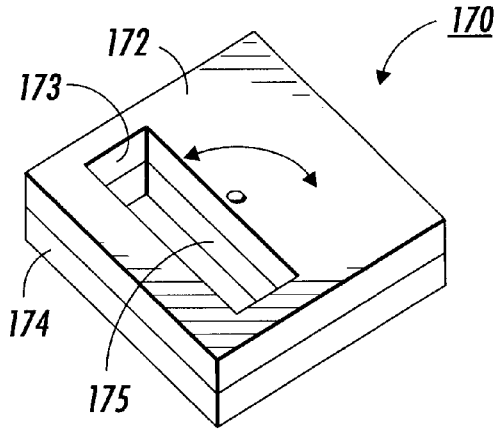
FIG. 12

FIG. 13
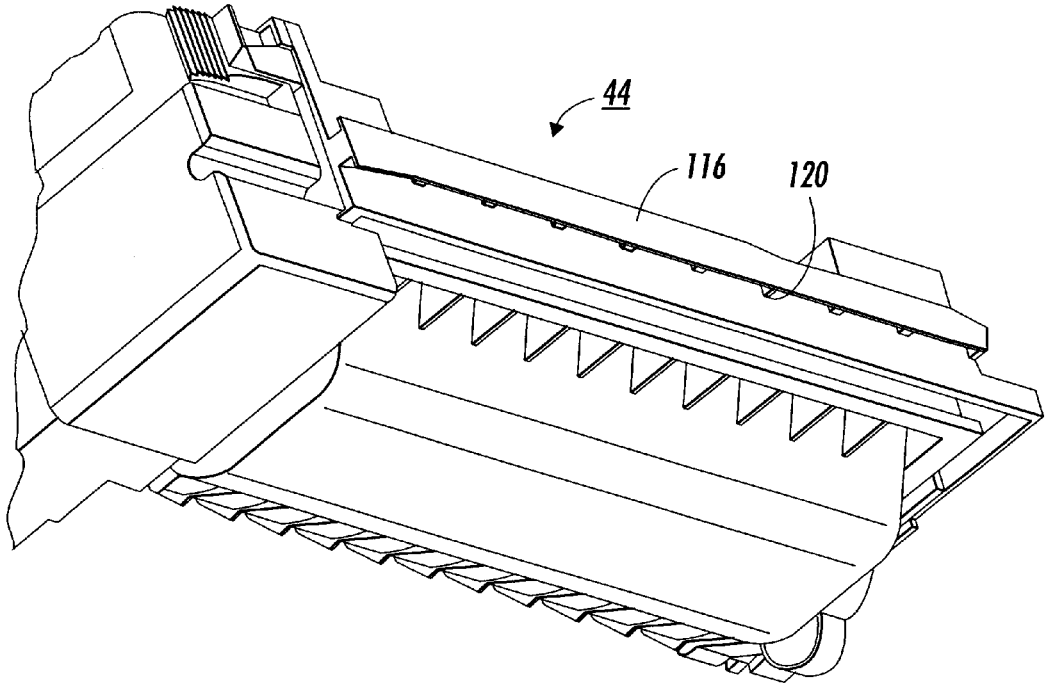
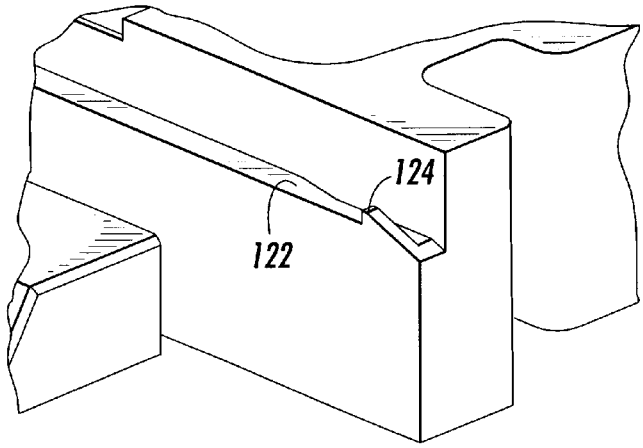
FIG. 14

FIG. 16
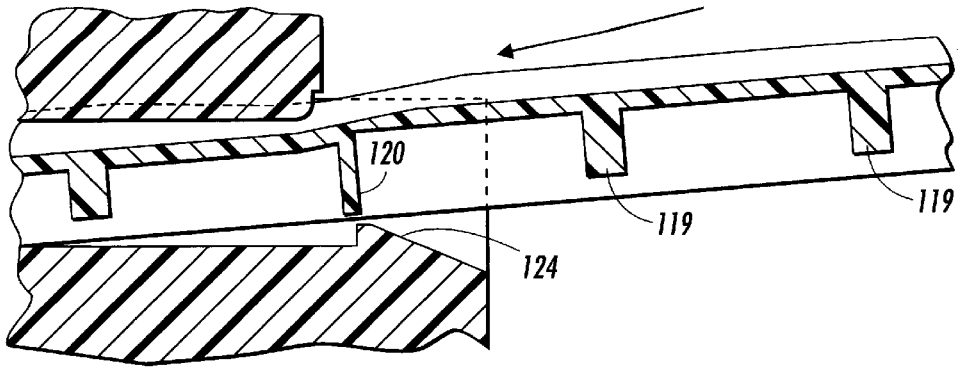
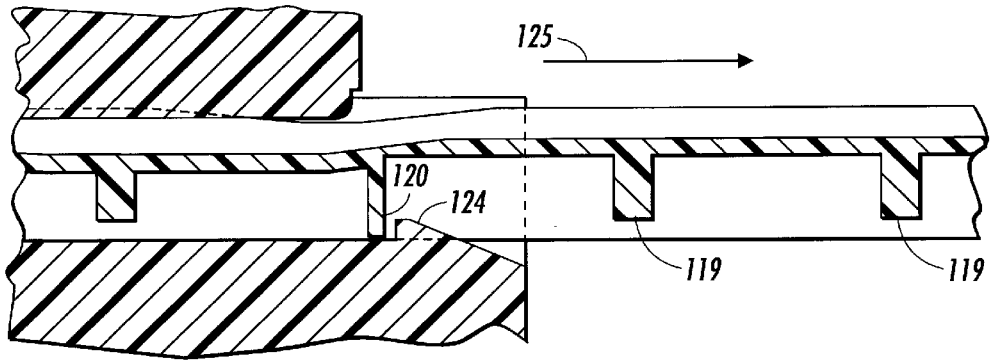
FIG. 17
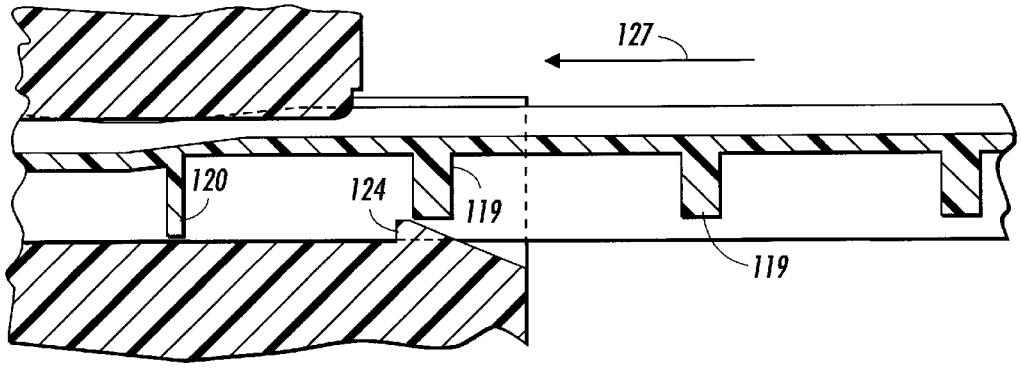
FIG. 18

MECHANICAL KEYING CONCEPT FOR REFILLABLE PRINT CARTRIDGE/TONER BOTTLE STRATEGY

This invention is related to U.S. Application Ser. No. 09/409,511, entitled "TONER BOTTLE PRINT CARTRIDGE VALVE FOR REFILLABLE PRINT CARTRIDGE/TONER BOTTLE STRATEGY"; U.S. Application Ser. No. 09/407,355, entitled "LOCKING MEMBER FOR REFILLABLE PRINT CARTRIDGE/TONER BOTTLE STRATEGY"; and U.S. Application Ser. No. 09/408,230, entitled "REFILLABLE ALL IN ONE PRINT CARTRIDGE/TONER BOTTLE STRATEGY", all filed Sep. 29,1999.

This invention relates to electrophotographic reproduction machines, and more particularly to a toner refilling container for a process cartridge for use in electrophotographic reproduction machines. Specifically this invention relates to such a toner refilling container with a built-in key.

Generally, the process of electrophotographic reproduction, as practiced in electrophotographic reproduction machines, includes charging a photoconductive member to a substantially uniform potential so as to sensitize the surface thereof. A charged portion of the surface of the photoconductive member is exposed at an exposure station to a light image of an original document to be reproduced. Typically, an original document to be reproduced is placed in registration, either manually or by means of an automatic document handler, on a platen for such exposure.

Exposing an image of an original document as such at the exposure station, records an electrostatic latent image of the original image onto the photoconductive member. The recorded latent image is subsequently developed using a development apparatus by bringing a charged dry or liquid developer material into contact with the latent image. Two component and single component developer materials are commonly used. A typical two-component dry developer material has magnetic carrier granules with fusible toner particles adhering triboelectrically thereto. A single component dry developer material typically including toner particles only can also be used. The toner image formed by such development is subsequently transferred at a transfer station onto a copy sheet fed to such transfer station, and on which the toner particles image is then heated and permanently fused so as to form a "hardcopy" of the original image.

It is well known to provide a number of the elements and components, of an electrophotographic reproduction machine, in the form of a customer or user replaceable unit (CRU). Typically such units are each formed as a cartridge that can be inserted or removed from the machine frame by a customer or user. Reproduction machines such as copiers and printers ordinarily include consumable materials such as toner, volume limiting components such as a waste toner container, and life cycle limiting components such as a photoreceptor and a cleaning device. Because these elements of the copying machine or printer must be replaced frequently, they are more likely to be incorporated into a replaceable cartridge as above.

There are therefore various types and sizes of cartridges, varying from single machine element cartridges such as a toner cartridge, to all-in-one electrophotographic toner image forming and transfer process cartridges. The design, particularly of an all-in one cartridge can be very costly and complicated by a need to optimize the life cycles of different elements, as well as to integrate all the included elements, while not undermining the image quality. This is particularly true for all-in-one process cartridges to be used in a family of compact electrophotographic reproduction machines having different volume capacities and elements having different life cycles.

Customer replaceable units (CRUs) which may also be known as cartridges, i.e., process cartridges, are intended to be removed and replaced by a fairly untrained operator of the copy or printing machine. The removal of the CRU and the replacement with a new a CRU is intended to be a simple, easy task. Typically, the CRU is replaced by first opening a cover or door and then sliding the CRU out of a cradle or location where the CRU fits within the machine. These CRUs are used to interact with the xerographic process and with the paper within the machine. Therefore, CRUs frequently need to be engaged into an operating position within the machine during the installation of the CRU. The CRU thus typically is slid or placed into the opening where it fits and then positioned into an operating arrangement within the printing machine. Typically, the used CRU must first be separated from the components with which it engages and then withdrawn from the printing machine. Similarly, a new replacement CRU must first be inserted into the machine and then interconnected with the operating portions of the printing machine. Such a typical CRU is in the form of a process cartridge.

In recent years, the replaceable print cartridge trend in small office/home office/desktop printers and copiers has been all-in-one single component development cartridges. This is evident through a quick study of recent industry print cartridges. One reason for this trend could be ease of customer use. A customer has only to replace one cartridge to replace the entire xerographic engine of their printer/copier. No separate dry ink, charging system cartridges, waste toner tanks, etc. need to be dealt with.

These all-in-one cartridges typically have lives of 2000 to upwards of 25,000 prints. Cartridge life is usually terminated by an electronic customer replaceable unit monitor (CRUM), a low toner sensor, or when the cartridge simply runs out of toner (giving light prints or deletions). The life limiting constraint for these cartridges is new toner capacity. All of the other components usually have life left in them when the toner runs out. This is why the recycle/refurbish industry for print cartridges is so profitable.

A common measure of the ownership cost of a cartridge is to take its initial cost divided by its life. To drive down ownership cost, either the initial cost of the cartridge must be reduced or the life of the cartridge must be extended. Both of these activities have limits, however.

The easiest way to reduce the initial cost of a cartridge is by driving down the cost through redesign or through the use of less expensive materials. Sometimes this strategy can backfire and end up costing more in the long run through quality issues or implementation costs. Even if the costing down activities are beneficial, the amount of cost that can be squeezed out of a design has a limit. Another way to drive down initial cost is through including a recycling/refurbishing factor. However, there are costs associated with returning and remanufacturing a cartridge. As the costs of cartridges keep getting driven toward their lower limits, the recycling costs often start to approach or exceed the costs associated with building a new cartridge.

This leads one to conclude that the best way to reduce ownership cost is to extend the life of the cartridge. However, as mentioned, the life of the cartridge is usually limited by the amount of new toner in the cartridge. To extend life, space for more toner in the machine must be found as well as cost effective means of delivering that extra-toner to the developer roll. This is not always possible or cost effective.

Another strategy for reducing the ownership cost has been to "split" the cartridge. The most common split cartridge design is a photoreceptor cartridge and a developer cartridge. The advantage to this strategy is that the photoreceptor cartridge can be run until its first component fails. The developer cartridge is then the only cartridge affected by new toner capacity. The split therefore decreases the amount of cost that is effected by the new toner capacity. The disadvantages of this strategy are that splitting the cartridges is challenging (dirty); the cost of the cartridges still are high (the costly developer roll is still frequently replaced); and the customer must now change two cartridges.

Yet another strategy for reducing the ownership cost has been to employ a separate toner cartridge that mounts in the machine. Toner is then delivered to the print cartridge from the toner cartridge. When the toner cartridge is empty, the customer replaces the toner cartridge, which does not contain a costly developer roll. The life of the print cartridge can then be extended until its first component fails. Disadvantages to this strategy again are: finding space within the machine to load an acceptable capacity toner cartridge; the costs associated with cleanly & effectively transporting the toner from the toner cartridge to the print cartridge; and the customer must again deal with two cartridges.

A new, unique strategy has been conceived to reduce the ownership cost (cost/copy) of a print cartridge. This strategy involves having the customer refill the "all-in-one" print cartridge with toner themselves with a refill bottle. The advantages are that toner is easily & cleanly replaced (resulting in lower cost); the cost of transporting the toner to the developer roll are the same as in an all-in-one cartridge; the toner bottle does not need to interface with the machine or reside within the machine; and all-in-one print cartridges could easily be sold alongside refillable print cartridges. Disadvantages to this strategy are now reduced to the operability concerns of a customer dealing with a print cartridge and a refill bottle. However, if successful, the cost of ownership associated with this strategy has been greatly reduced. The customer is essentially refurbishing the print cartridge themselves and extending the life of the cartridge until the first component failure. This strategy does not yet exist in the print cartridge industry.

Dealing with the new strategy of refilling, verses replacing, a digital print cartridge when the toner runs out, created some new, unique design challenges. Marketing, based on customer input, asked that this new refill strategy be enabled without removing the cartridge from the machine. This allows the customer to work entirely at the machine without using a separate work surface. Any toner leakage, even if it is minor leakage, will then be contained within the machine.

A simple, cost-effective solution was implemented for this new refill strategy that satisfies market requests. The design allows the cartridge to easily be inserted into the machine. Upon removal, the print cartridge is stopped before being fully removed from the machine. At this point, the customer can refill the cartridge with toner, without using a separate work surface, and then simply push the cartridge back into the machine. To fully remove the cartridge, when the cartridge needs to be replaced, the customer pulls the cartridge out to the stop, lifts slightly, and then fully removes the cartridge. A new strategy for print cartridges has evolved to drive down the cost per copy for low volume digital printer/copiers. This strategy involves refilling the replaceable print cartridge several times during the life of the cartridge before ultimately replacing the entire print cartridge. Along with this strategy, the market has requested that the toner refill bottles have the ability to be configured such that they will only refill specifically configured print cartridges. This allows a single company the ability to manufacture print cartridges for other customers. For example, a Xerox® configured print cartridge will only accept Xerox® configured toner bottles, not some other company configured toner bottles.

The solution to the market request is to provide a rotating shutter mechanism to cleanly and easily refill the print cartridge. A mechanical keying strategy was implemented such that a specific configuration toner bottle has a unique cap. This cap determines the configuration of the toner bottle. Also, the print cartridge has a unique shutter that determines its configuration. Only if the unique cap of the toner bottle fits with the unique print cartridge shutter, will the customer be able to mate the two and refill the toner. Multiple configurations can be developed by only slightly varying the mechanical keys located on the cap and the shutter.

An additional strategy was developed to protect the quality of toner supplied and to deter other toner suppliers from supplying inferior quality toner. Instead of using a pattern of posts and holes as the mechanical key, the concept is to use the company logo or trademark as the mechanical key. For example, the Xerox digital "X" could be used as the mechanical key. Therefore, if any configuration key other than the digital X is used, the customer will either not be able to get the bottle to fit onto the cartridge, or the cap will not turn the shutter on the cartridge as the bottle is turned. A 3$^{rd}$ party toner supplier would be prevented from manufacturing the cap, as they would not have the ability to use another company's trademark.

The following disclosures may be relevant to various aspects of the present invention:

U.S. Pat. No. 5,857,129
Applicant: Harris
Issue Date: Jan. 5, 1999
U.S. Pat. No. 5,848,338
Applicant: Okada
Issue Date: Dec. 8, 1998
U.S. Pat. No. 5,812,915
Applicant: Farkash
Issue Date: Sep. 22, 1998
U.S. Pat. No. 5,734,953
Patentee: Tatsumi et al.
Issue Date: Mar. 31, 1998
U.S. Pat. No. 5,678,121
Patentee: Meetze, Jr. et al.
Issue Date: Oct. 14, 1997
U.S. Pat. No. 5,655,181
Patentee: Chadani et al.
Issue Date: Aug. 5, 1997
U.S. Pat. No. 5,630,198
Patentee: Makino
Issue Date: May 13, 1997
U.S. Pat. No. 5,615,001
Patentee: Kawashima et al.
issue Date: Mar. 25, 1997
U.S. Pat. No. 5,559,589
Patentee: Eichberger et al.
Issue Date: Sep. 24, 1996
U.S. Pat. No. 5,383,502
Patentee: Fisk, et al.
Issue Date: Jan. 24, 1995

U.S. Pat. No. 5,331,382
Patentee: Miura et al.
Issue Date: Jul. 19, 1994
U.S. Pat. No. 5,150,807
Patentee: Seyfried, et al.
Issue Date: Sep. 29, 1992
U.S. Pat. No. 5,091,750
Applicant: Yoshida et al.
Issue Date: Feb. 25, 1992
U.S. Pat. No. 5,089,854
Patentee: Kaieda et al.
Issue Date: Feb. 18, 1992
U.S. Pat. No. 5,074,344
Applicant: Vacek et al.
Issue Date: Dec. 24, 1991
U.S. Pat. No. 4,650,070
Patentee: Oka, et al.
Issue Date: Mar. 17, 1987

The relevant portions of the foregoing disclosures may be briefly summarized as follows:

U.S. Pat. No. 5,857,129 discloses a device for storing a supply of particles for use in one of a first developer unit of a first electrophotographic printing machine and a second developer unit of a second electrophotographic printing machine. The device is comparable to one of a first mechanism of the first developer unit of the first electrophotographic printing machine and a second mechanism of the second developer unit of the second electrophotographic printing machine to feed the particles from the device into one of the first developer unit and the second developer unit. The first mechanism includes a first mechanism feature and the second mechanism includes a second mechanism feature. The device includes a container defining a chamber for storing particles therein. The container defines an aperture therein. The first mechanism further includes a first member removably connectable to the container. The first member includes a first member feature. The first member feature when connected to the container is engagable with the first mechanism feature. The first member feature when connected to the container prevents engagement with the second mechanism feature. Wherein the device may be mounted into the first printing machine and be utilized to feed the particles from the device into the first developer unit and wherein mounting of the device into the second printing machine is prevented.

U.S. Pat. No. 5,848,338 discloses a toner replenishing device including a mounting base having a toner replenishment opening formed for replenishing a hopper with a toner, and a toner cartridge to be mountable on the mounting base at a replenishing position at which the toner can be replenished through the toner replenishment opening. The mounting base is provided with a replenishment opening shutter member, and locking means for inhibiting the turning of the replenishment opening shutter member. When the toner cartridge is mounted at the replenishing position, locking of the locking means is released, and when the container is turned, a through-hole of the toner cartridge and the toner replenishment opening open.

U.S. Pat. No. 5,812,915 discloses a plug for use in plugging an aperture in a container for storing a supply of particles for use in a developer unit of an electrophotographic printing machine. The plug includes a base and a rim extending from the periphery of the base. The rim may cooperate with the aperture. The plug further includes a stem extending from the base and spaced from the rim, so that the rim may conform to the aperture and thereby seal the aperture without being affected by the handle.

U.S. Pat. No. 5,734,953 discloses an image forming apparatus having independently detachable toner supply units and image processing units. The toner supply units include a toner supply port, a first shutter controlling a toner flow path of the toner supply port, and a first guide rib formed on the toner supply unit. The image processing units include a toner acceptance port, a second shutter controlling the toner flow path of the toner acceptance port, and a second guide rib formed on the image processing unit. The first and second guide ribs engage the second and first shutters when the toner supply unit and the image processing unit are both attached to the main body of the image forming apparatus. If either the toner supply unit or the image processing unit is removed from the main body, the guide ribs disengage the corresponding shutters, causing the shutters to close the toner flow paths. Reassembling the toner supply unit with the image processing unit engages the shutters to reopen the toner flow paths.

U.S. Pat. No. 5,678,121 discloses a hard copy document production machine using a plurality of different type of cartridges containing different document production consumable materials, an orientation-independent cartridge type discriminating system assembly suitable for enabling non-burdensome, orientation-independent loading of a correct cartridge into a cartridge opening in the machine, and for resiliently intercepting and preventing loading of an incorrect cartridge into the cartridge opening. The discriminating system assembly includes a resilient assembly mounted to a portion of the frame of the machine defining the cartridge opening, a first spring member, and a pivotable elongate member connected to the spring member for providing resilient cartridge contact with a cartridge being inserted. The elongate member has a displaceable portion, and a cartridge blocking portion spaced from the displaceable portion in a direction of cartridge insertion. The displaceable portion has a cartridge-type first specific distance measured from the cartridge blocking portion, and the cartridge blocking portion has a first position within the cartridge opening, and a second position adjacent the cartridge opening. The discriminating system assembly also includes a displacer device formed on a surface of a cartridge being inserted into the cartridge opening, and has a cartridge-type specific second distance measured from a lead edge of a cartridge of the type of cartridge being inserted. The cartridge-type specific second distance determines a correct cartridge when it is equal to the cartridge-type specific first distance, and the displacer device extends continuously and uniformly in a direction transverse to the direction of cartridge insertion, so as to enable non-burdensome, orientation-independent loading of a cartridge into the cartridge opening.

U.S. Pat. No. 5,655,181 discloses a toner accommodation container for containing toner to be used for developing a latent image formed on an electrophotographic photosensitive member, wherein the toner accommodation container is supplied with toner from a toner supply container that includes a toner accommodating portion for accommodating the toner; a toner supply opening for supplying toner; a cover member for covering the toner supply opening, wherein the cover member is movable between a closing portion for covering the toner supply opening and an open position for permitting supply of the toner therethrough; a blocking member, provided inside the covering member, for preventing the toner from scattering from the toner accommodating portion to outside, the blocking member is locked by a first locking member and a second locking member; wherein the blocking member is movable to the open position by the first locking member being released by the toner supply container and the second locking member being released by the cover member.

U.S. Pat. No. 5,630,198 discloses a toner fillable cartridge for use with a toner developing device that includes a toner body having first and second ends, a toner exhaust port between the first and second ends, a toner box shielding member rotatably mounted on the toner body to open and close the toner exhaust port as the toner body is rotated with respect to the development device and the toner box shielding member, and a pair of protrusions formed on each side of the toner box shielding member. Each of the pair of protrusions are structured to engage a developing device shielding member movably positioned over a toner introduction port of the developing device. Rotation of the toner body with respect to the development device causes each of the pair of protrusions to engage and displace the developing device shielding member to open and close the toner introduction port as the toner exhaust port rotates to align with the toner introduction port.

U.S. Pat. No. 5,615,001 discloses a plurality of electrostatic recording units being arranged in series along a path for moving a recording sheet of paper, and charged toner images having different colors are formed on the sheet of paper traveled through the path. A paper feeder unit is arranged beneath a paper introduction side of the paper moving path. The sheet of paper carrying the toner image formed thereon is ejected from a paper ejection side of the paper moving path, and is sent to a fixer in which the toner image is fixed on the sheet of paper. The sheet of paper carrying the toner image fixed thereon is sent to a paper receiver tray positioned above the fixer.

U.S. Pat. No. 5,559,589 discloses an improved keying system for categorizing a consumable cartridge by using a two component system including a relatively long-lived portion and the relatively short-lived consumable cartridge. The improved system includes a lug element and a structure for mounting the lug element to the relatively longlived portion, which may be the inner housing of a copier machine or other machine using consumable cartridges. Ideally, the lug element is self-fixturing into a void space. The consumable cartridge has portions defining a void into which the lug element projects when the consumable cartridge is inserted into the relatively long-lived portion for machine operations.

U.S. Pat. No. 5,383,502 discloses an imaging material replenishment system for a reproduction apparatus, with an imaging material container removably insertable into an insertion guide, which container has a containment lid automatically removed upon insertions with a lid latching member with a latching notch normally latching the containment lid to the container. The insertion guide has a latch engaging member such as a fixed pin positioned to engage an unlatching ramp surface of the lid latching member as the container is inserted, a locking slot returning the pin therein during dispensing, and thus holding the lid there, and another, oppositely inclined, ramp surface automatically relatching the lid to the container as the container is removed after dispensing. An integrated contents encoding and interlock system is also provided.

U.S. Pat. No. 5,331,382 discloses a toner cartridge for an image forming apparatus including a case body having a tubular portion, first and second end walls, and first and second positioning members. The first positioning member radially protrudes from the first end wall and has a flat end face. The first positioning member, which is used for positioning the toner cartridge at the start of loading the toner cartridge into the image forming apparatus, is aligned with a first guide in the image forming apparatus at the start of loading the toner cartridge. The second positioning member, which radially protrudes from the second end wall of the cartridge and has a flat end face, is angularly shifted from the first positioning member. After the first positioning member is aligned with the guide, the cartridge is rotated to align the second positioning member with a second guide in said image forming apparatus.

U.S. Pat. No. 5,150,807 discloses an apparatus for storing marking particles which includes a container defining a chamber for storing the marking particles therein and having an opening defined therein for the discharge of the marking particles therefrom. The apparatus further includes a seal member secured to the container, the seal member having an opening defined therein which is at least partially coextensive with the opening of the container for the passage of marking particles therethrough. Moreover, the apparatus includes a cover positionable over the opening defined in the seal member, the cover being removably secured to the seal member with an adhesive material.

U.S. Pat. No. 5,091,750 discloses a toner cartridge unit for a copying machine having a double shutter at the mouth of the toner cartridge. The double shutter is locked when the cartridge is not attached to a toner hopper of the copying machine and prevents toner from coming out. Owing to the double shutter structure, the outside of the cartridge is always clean. When the cartridge unit is attached to the hopper, many locking and releasing mechanisms for the double shutter and a third shutter provided at the hopper entrance work sequentially and automatically as the cartridge is moved from a preparation site to a supplying site of the toner hopper.

U.S. Pat. No. 5,089,854 discloses an apparatus for supplementing a toner into a toner hopper of a developing device using the toner including a toner supplementing container having a toner bottle having an opening, a shutter member movable between a closed position in which the opening of the toner bottle is closed by the shutter member and an open position in which the opening of the toner bottle is not closed by the shutter member, and a shutter locking member for locking the shutter member into the closed position; and a container fixing and locking mechanism arranged on the toner hopper and having a fixing member for fixing the toner supplementing container onto the toner hopper and a locking member which is movable into a locked position in which the shutter locking member is released to allow the movement of the shutter member into the open position and the toner supplementing container cannot be removed from the toner hopper and an unlocked position in which the toner supplementing container can be removed from the toner hopper and the shutter member is locked in the closed position. When the shutter member is moved into the open position, the user cannot handle the container locking member, because the container locking member is hidden by the shutter member. In this manner, the toner can be positively and easily supplemented into the developing device by means of the toner hopper without causing undesired spread of the toner.

U.S. Pat. No. 5,074,344 discloses a toner container that includes a containing portion and a cover. The cover is generally to be positioned adjacent a toner sump and the containing portion slides off the cover onto the sump. To prevent accidental removal of the cover when the container is not in a receiving apparatus, a releasable latch is provided for holding the cover on the container. The latch is releasable by the same motion used to position the containing portion over the sump.

U.S. Pat. No. 4,650,070 discloses a toner cartridge for use in replenishing additional toner to a toner storing section of an imaging machine, such as an electrophotographic copier, which uses toner to produce a visible image. The present toner cartridge includes a trough-shaped container having an opening, a cover which is large enough to encompass the opening and supported to be slidably movable with respect to the container between a closed position to close the opening and an open position to open the opening, and a seal member having one end fixed to the container and another end fixed to the cover. Thus, when the cover is moved from the closed position to the open position, the seal member is partly separated away from the container to make the opening half-open. Then, the seal member is pulled to completely open the opening to have the toner completely discharged from the container. Thereafter, the cover is returned to the closed position to close the opening. With such a structure, toner is completely prevented from being scattered.

In accordance with one aspect of the present invention, there is provided a container for delivering a supply of particles for use in a developer unit of an electrophotographic printing machine, the container being fittable to an adapter associated with the developer unit, the container comprising a body defining a chamber for storing particles therein, said body defining an aperture in an end thereof and a cover for use in covering the aperture, wherein said cover comprises a valve mechanism and a keying feature, wherein said keying feature cooperates with a portion of the developer unit so that upon rotation of the container, said valve mechanism is actuated.

Other features of the present invention will become apparent as the following description proceeds and upon reference to the drawings, in which:

FIG. 5 is a top perspective view of the module housing the CRU or process cartridge module of the machine of FIG. 1 without a toner bottle inserted;

FIG. 6 is a detailed top perspective view of the toner fill aperture of the module housing the CRU our process cartridge module;

FIG. 7 is a detailed top perspective view of the toner fill aperture of the module including an indicia of source as the mechanical key;

FIG. 8 is a perspective view of the toner bottle;

FIG. 9 is detailed perspective view of the fill nozzle of the toner bottle;

FIG. 10 is a detailed perspective view of the fill nozzle of the toner bottle including an indicia of source as the mechanical key;

FIGS. 11 and 12 are schematic representations of the toner fill valve showing the valve in the close and open positions respectively;

FIG. 13 is a bottom perspective view of the module housing the CRU or process cartridge madule illustrating the locking lip;

FIG. 14 is a detailed perspective view of the lower machine chassis;

FIGS. 16–18 are detailed side views of the locking mechanism illustrating the locking and refilling position of the process module.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 1:
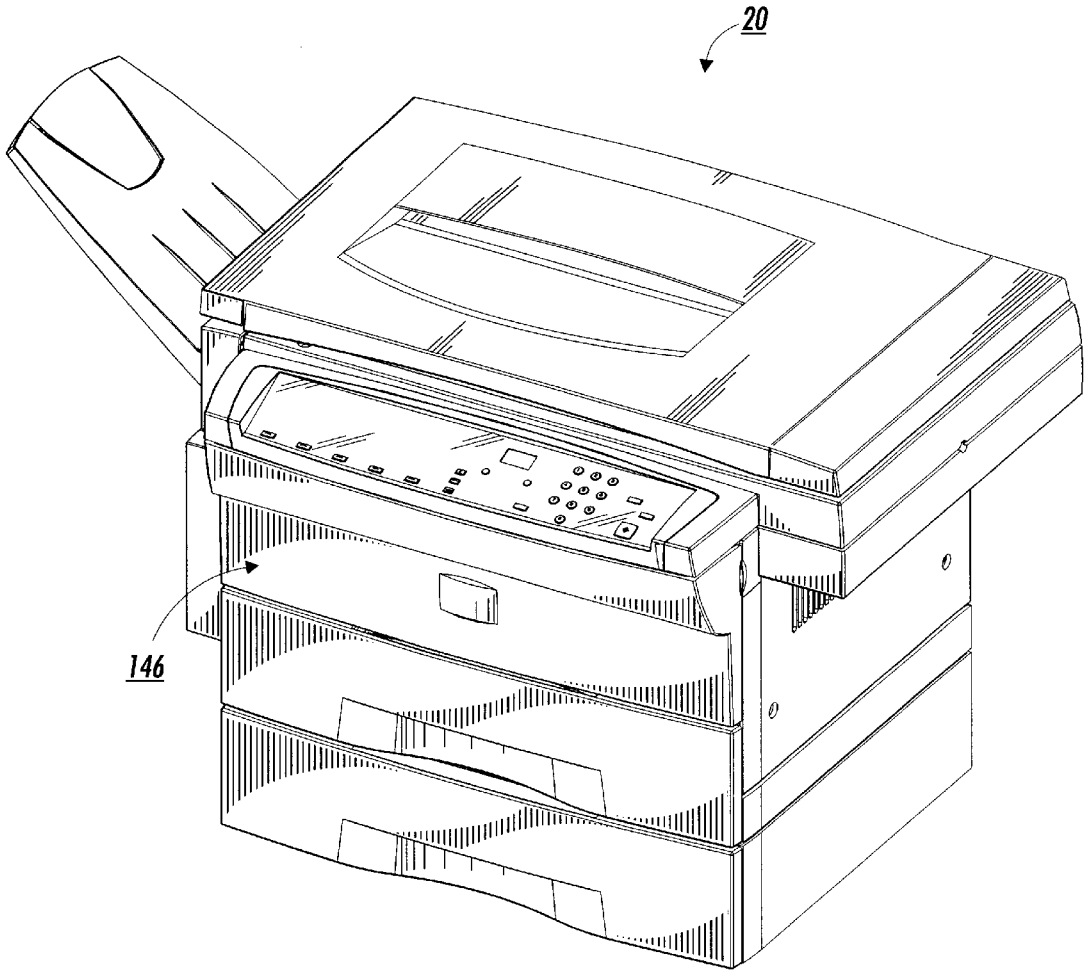
FIG. 1 is a perspective view of an exemplary electrophotographic printing machine.
Figure 2:
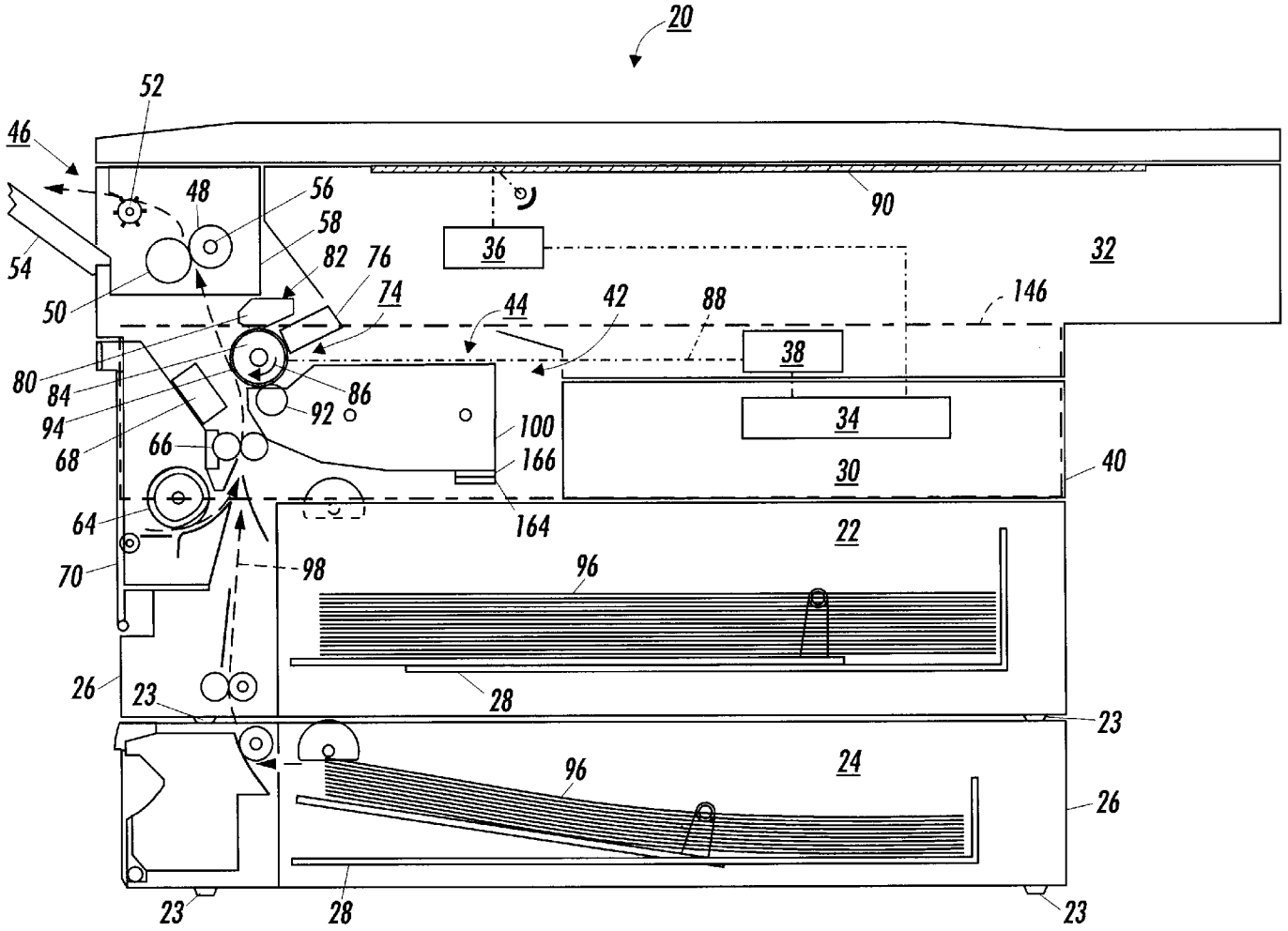
FIG. 2 is an elevational view of an exemplary electrophotographic reproduction machin in accordance with the present invention.

Referring now to FIGS. 1 and 2, there is illustrated a frameless exemplary electrophotographic reproduction machine 20 including separately framed mutually aligning modules. The machine 20 may be frameless, meaning that it does not have a separate machine frame to which electrophotographic process subsystems are assembled, aligned to the frame, and then aligned relative to one another as is typically the case in conventional machines. Instead, the architecture of the compact machine 20 may include a number of individually framed, and mutually aligning machine modules that variously include pre-aligned electrophotographic active process subsystems.

As shown in FIG. 2, the machine 20 may include a framed copy sheet input module (CIM) 22. Preferably, the machine 20 includes a pair of copy sheet input modules, a main or primary module the (CIM) 22, and an auxiliary module (ACIM) 24, each of which has a set of legs 23 that can support the machine 20 on a surface, therefore suitably enabling each CIM 22, 24 to form a base of the machine 20. As also shown, each copy sheet input module (CIM, ACIM) includes a module frame 26 and a copy sheet stacking and lifting cassette tray assembly 28 that is slidably movable in and out relative to the module frame 26. When as preferred here, the machine 20 includes two copy sheet input modules, the very base module is considered the auxiliary module (the ACIM), and the top module which mounts and mutually aligns against the base module is considered the primary module (the CIM).

The machine 20 next includes a framed electronic control and power supply (ECS/PS) module 30, that as shown mounts onto, and is mutually aligned against the CIM 22 (which preferably is the top or only copy sheet input module). A framed latent image forming imager module 32 then mounts over and is mutually aligned against the ECS/PS module. The ECS/PS module 30 includes all controls and power supplies (not shown) for all the modules and processes of the machine 20. It also includes an image processing pipeline unit (IPP) 34 for managing and processing raw digitized images from a Raster Input Scanner (RIS) 36, and generating processed digitized images for a Raster Output Scanner (ROS) 38. The ECS/PS module 30 also includes harnessless interconnect boards and inter-module connectors (not shown), that provide all power and logic paths to the rest of the machine modules. An interconnect board (PWB) (not shown) connects the ECS controller and power supply boards (not shown) to the inter-module connectors, as well as locates all of the connectors to the other modules in such a manner that their mating connectors would automatically plug into the ECS/PS module during the final assembly of the machine 20. The ECS/PS module 30 may include a module frame 40 to which the active components of the module as above are mounted, and which forms a covered portion of the machine 20, as well as locates, mutually aligns, and mounts to adjacent framed modules, such as the CIM 22 and the imager module 32.

The framed copy sheet input modules 22, 24, the ECS/PS module 30, and the imager module 32, as mounted above, define a cavity 42. The machine 20 may include a process cartridge module 44 that is insertably and removably mounted within the cavity 42, and in which it is mutually aligned with, and operatively connected to, the framed CIM, ECS/PS and imager modules 22, 30, 32.

As further shown, the machine 20 may include a framed fuser module 46, that is mounted above the process cartridge module 44, as well as adjacent an end of the imager module 32. The fuser module 46 includes a pair of fuser rolls 48, 50, and at least an exit roll 52 for moving an image carrying sheet through, and out of, the fuser module 46 into an output or exit tray 54. The fuser module also includes a heater lamp 56, temperature sensing means (not shown), paper path handling baffles (not shown), and a module frame 58 to which the active components of the module, as above, are mounted, and which forms a covered portion of the machine 20, as well as locates, mutually aligns, and mounts to adjacent framed modules, such as the imager module 32 and the process cartridge module 44.

The machine 20 may include active components including a bypass feeder assembly 64, sheet registration rolls 66, toner image transfer and detack devices 68, and the fused image output or exit tray 54. The machine 20 may include drive coupling components and electrical connectors (not shown), and a module frame 70 to which the active components are mounted, and which forms a covered portion of the machine 20, as well as, locates, mutually aligns, and mounts to adjacent framed modules, such as the CIM 22, the process cartridge module 44, and the fuser module 46.

Referring again to FIG. 2, the CRU 44 or process cartridge module 44 may optionally include a photoreceptor subassembly 74, a charging subassembly 76, developer housing 100 including a source of fresh developer material, a cleaning subassembly 80 for removing residual toner as waste toner from a surface of the photoreceptor, and a waste toner sump subassembly 82 for storing waste toner. The process cartridge module 44 importantly provides and includes supporting, locating and aligning structures, as well as driving components for the process cartridge module 44.

Still referring to FIG. 2, operation of an imaging cycle of the machine 20 using the process cartridge module 44 generally, can be briefly described as follows. Initially, a photoreceptor in the form of a photoconductive drum 84 of the customer replaceable unit (CRU) or process cartridge module 44, rotating in the direction of the arrow 86, is charged by the charging subassembly 76. The charged portion of the drum is then transported to an imaging/exposing light 88 from the ROS 38 which forms a latent image on the drum 84, corresponding to an image of a document positioned on a platen 90, via the imager module 32. It will also be understood that the imager module 32 can easily be changed from a digital scanning module to a light lens imaging module.

The portion of the drum 84 bearing a latent image is then rotated to the developer housing 100 where the latent image is developed with developer material such as with charged single component magnetic toner using a magnetic developer roller 92 of the process cartridge module 44. The developed image on the drum 84 is then rotated to a near vertical transfer point 94 where the toner image is transferred to a copy sheet substrate 96 fed from the CIM 22 or ACIM 24 along a copy sheet or substrate path 98. In this case, the detack device 68 of the door module (not shown) is provided for charging the back of the copy sheet substrate (not shown) at the transfer point 94, in order to attract the charged toner image from the photoconductive drum 84 onto the copy sheet substrate.

The copy sheet substrate with the transferred toner image thereon, is then directed to the fuser module 46, where the heated fuser roll 48 and pressure roll 50 rotatably cooperate to heat, fuse and fix the toner image onto the copy sheet substrate.

The copy sheet substrate then, as is well known, may be selectively transported to the output tray 54 or to another post-fusing operation.

The portion of the drum 84 from which the developed toner image was transferred is then advanced to the cleaning subassembly 80 where residual toner and residual charge on the drum 84 are removed therefrom. The imaging cycle of the machine 20 using the drum 84 can then be repeated for forming and transferring another toner image as the cleaned portion again comes under the charging subassembly 76.

Figure 3:
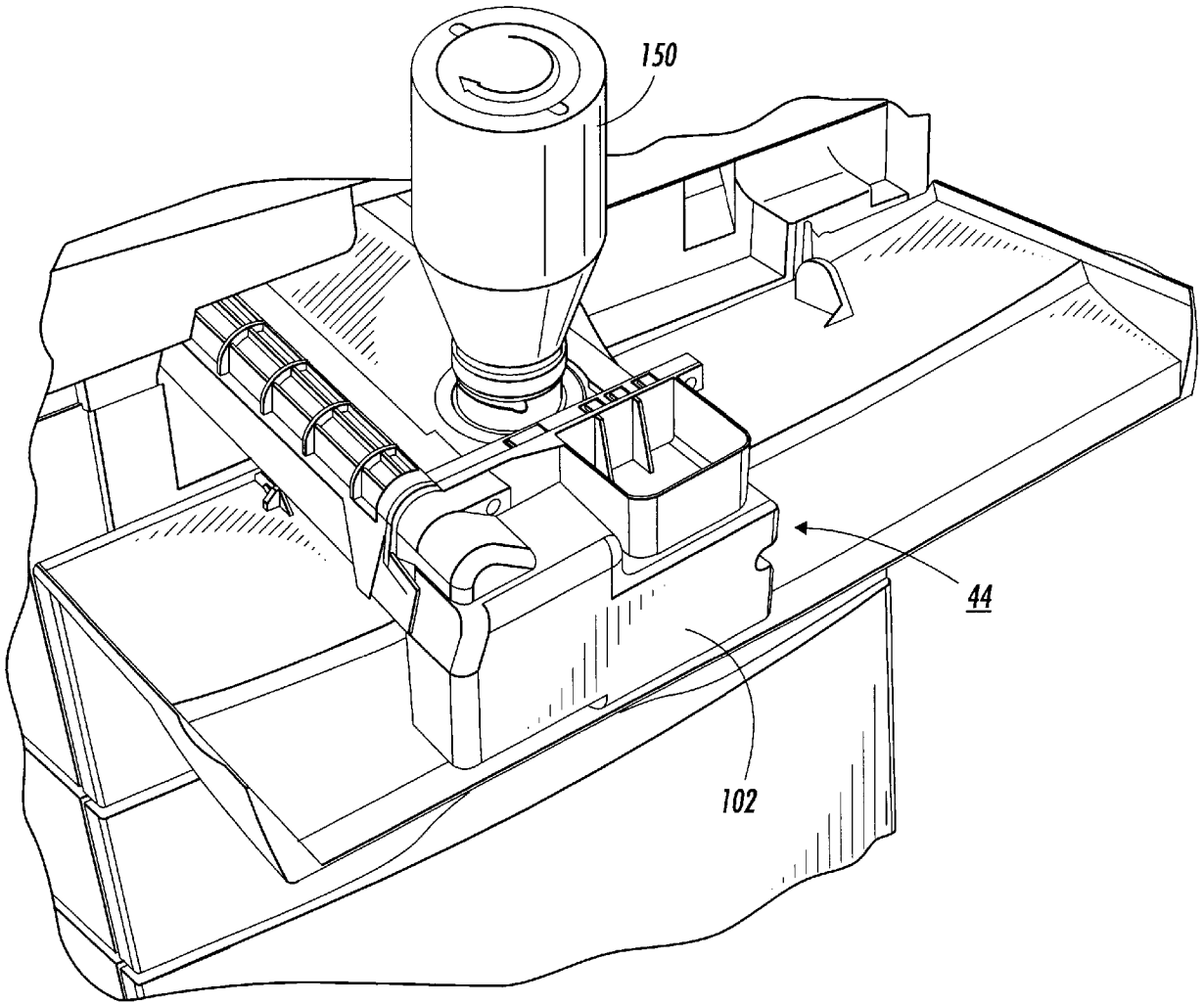
FIG. 3 is a perspective view illustrating the refillable process cartridge in the "load" position.
Figure 4:
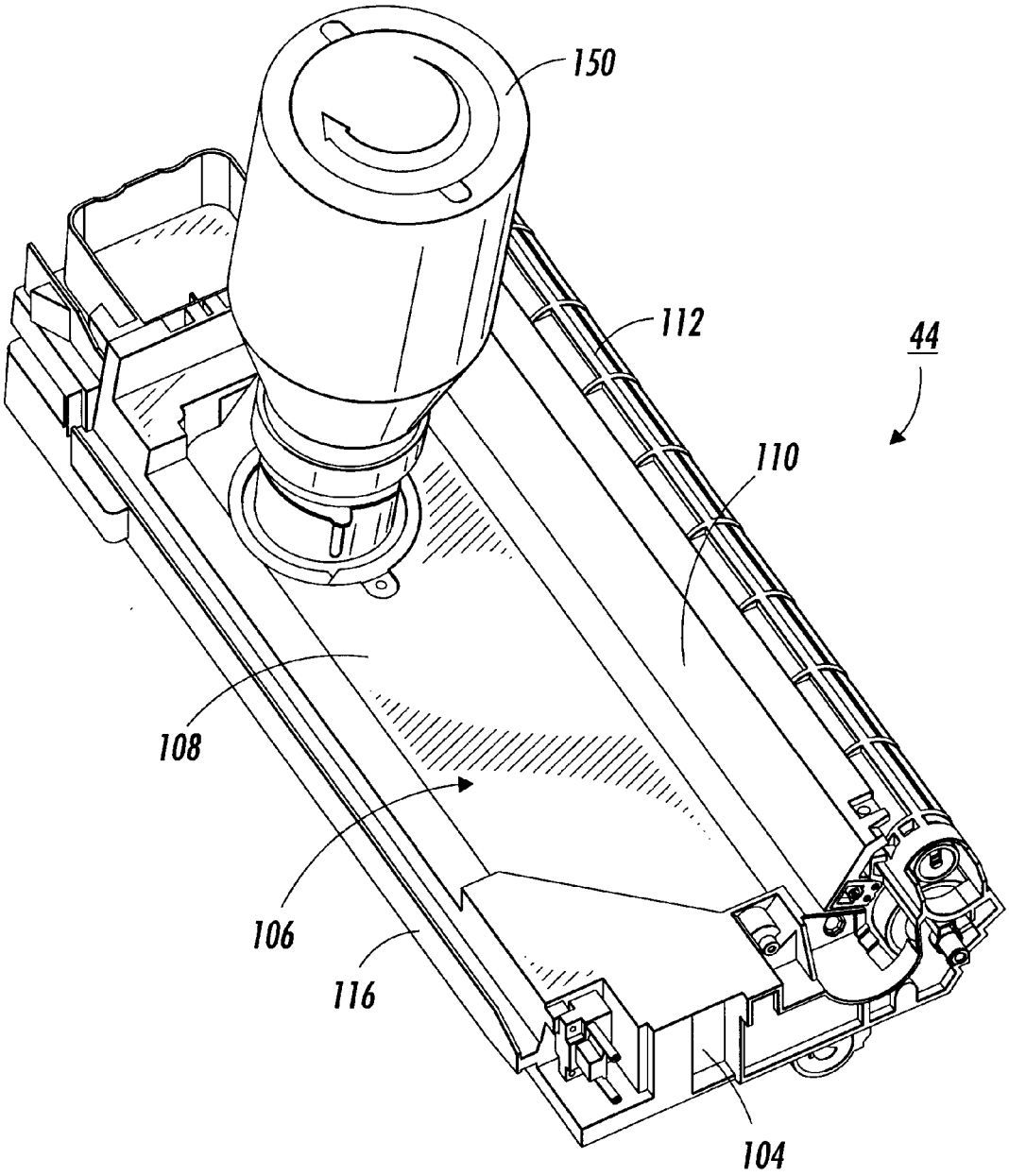
FIG. 4 is a top perspective view of the module housing the CRU or process cartridge module of the machine of FIG. 1 with a toner bottle inserted.
Figure 15:
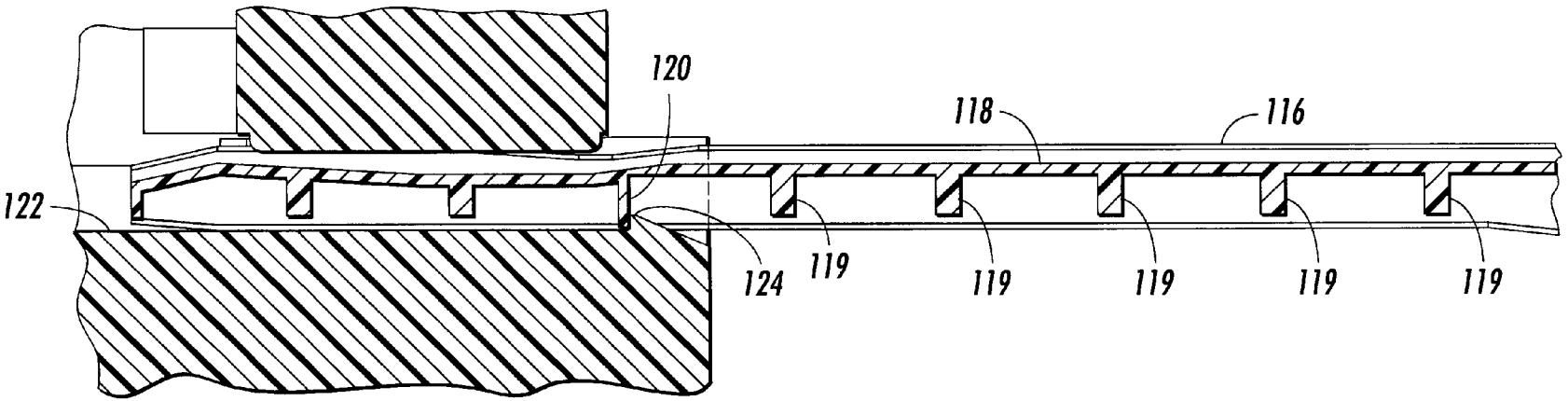
FIG. 15 is a side cross section view of the process module machine chassis illustrating the cooperation therebetween.

Referring now to FIGS. 3, 4 and 5, the process cartridge module 44 is illustrated. As shown, it includes a developer housing 100 having a first end wall 102, a second and opposite end wall 104, a top wall 106 including a substantially horizontal portion 108 and a nearly vertical portion 110 defining a raised side portion 112. The trough shaped module housing also includes a front end wall 116 that connects at an angle to the top wall 106.

As shown in FIG. 1, the machine 20 includes a cover 146 for providing access to the CRU cavity 42 when opened and to provide protection from dust and to prevent inadvertent access to the internal workings of the machine 20. The cover 146 may, for example, be in the form of a removable cover or in the form of a portion of a drawer which may be slid outwardly from the machine 20. As shown in FIG. 3, the cover 146 is in the form of a door which as shown in FIG. 3 is hinged about hinges (not shown) connecting the lower end of the cover 146 to the frame (not shown) of the machine 20. The cover 146 is utilized to cover a portion of the machine. For example, as shown in FIG. 3, the cover 146 is utilized to cover the CRU 44.

Turning now to FIG. 3, there is illustrated the process cartidge or CRU 44 indicating the CRU 44 in the reload position in the machine 20. The access cover 146 of the machine is shown in the open position and the CRU 44 is shown extended to the refill position with the toner bottle 150 inserted to refill toner into the CRU 44. Once the bottle 150 has been emptied, it is twisted and removed and the CRU 44 is inserted back into the machine 20 and the cover 146 closed to allow the machine to be in the operative mode.

Turning next to FIGS. 4–8, the CRU is illustrated showing how the toner bottle 150 is inserted and the detail of the toner bottle 150/CRU 44 cooperative engagement. FIG. 4 illustrates the CRU 44 with the toner bottle 150 inserted and rotated so that the toner is free to flow into the sump of the CRU 44. FIG. 5 illustrates the CRU 44 with the toner bottle 150 removed illustrating the engagement socket 160 further detailed in FIG. 6. Turning next to FIGS. 7 and 8, the engagement portion of the toner bottle nozzle 152 is illustrated showing the keying feature 154 of the toner bottle nozzle 152 that interacts with the receptacle feature 164 of the socket for the keying feature 154 in FIG. 6. When the toner bottle 150 is inserted and the keying feature 154 is properly aligned in the receptacle feature 164, the proper engagement is then accomplished to allow rotation of the toner bottle 150 which performs several functions: a) locking the bottle with a flange 158 into CRU 44; b) opening the a valve mechanism 166 built into the CRU 44 receptacle and c) opening a valve mechanism 156 in the toner bottle 150.

This mechanical keying strategy should be implemented such that a specific configuration toner bottle has a unique cap i.e. "key". This cap determines the configuration of the toner bottle. Also, the print cartridge has a receptacle feature that determines its configuration. Only if the unique cap of the toner bottle fits with the unique print cartridge receptacle feature, will the customer be able to mate the two and refill the toner. Multiple configurations can be developed by only slightly varying the mechanical keys located on the cap and the shutter.

An additional strategy was developed to protect the quality of toner supplied and to deter other toner suppliers from supplying inferior quality toners. Instead of using a pattern of posts and holes as the mechanical key, the concept is to use the company logo or trademark as the mechanical key. For example, as shown alternatively in FIGS. 7 and 10, the Xerox digital "X" 254, 264 could be used as the mechanical key. Therefore, if any configuration key other than the digital X is used, the customer will either not be able to get the bottle to fit onto the cartridge, or the cap will not turn the shutter on the cartridge as the bottle is turned. A 3rd party toner supplier would be prevented from manufacturing the cap, as they would not have the ability to use another company's trademark.

The valve mechanisms 156, 166 used in both the bottle and the CRU 44 are schematically illustrated in FIGS. 11 and 12. The valve referred to generically as reference numeral 170 is made up of two coplanar members 172, 174 that are in contact with and rotatable respectively to each other. There are substantially identical apertures 173, 175 in each of the coplanar members. The apertures 173, 175 are located so that when rotated 180° in one direction, the apertures are aligned and allow an opening through both of the members 172, 174, and when rotated 180° the apertures are not aligned and provide a seal for the opening.

Thus, to summarize the operation of the refilling of the CRU 44, illustrated in FIGS. 3–10, the machine access cover 146 is opened and the CRU 44 is withdrawn until it contacts a stop described hereafter with respect to FIGS. 13–18. At that time, a toner bottle 150 having the keying feature 154 described above is aligned with the receptacle feature 164 in the engagement socket 160 in the CRU 44. The toner bottle 150 is then rotated 180° which locks the toner bottle to the CRU 44 and causes the value mechanism 166 in the CRU 44 to open. The toner bottle is then rotated another 180° which opens the mechanism 156 in the bottle nozzle 152 and allows toner to flow into the CRU 44. Once the contents of the toner bottle 150 have been emptied into the CRU 44, the toner bottle 150 is then rotated again in the opposite direction and the toner bottle 150 is removed. As the mechanism 156 in the toner bottle is opened last and closed first, this prevents toner from being inadvertently spilled while the toner bottle 150 is being inserted and removed from the CRU 44. After the toner bottle 150 is removed, the CRU 44 is reinserted into the machine 20 and the machine is again ready for operation. The mechanism described allows the customer to affix a toner refill bottle to a CRU 44, and "recharge" the CRU 44 instead of removing and returning the process cartridge.

The effect of the double acting rotating shutter is to allow for a clean transfer of new toner to the print cartridge. Refilling the cartridge 44 increases the economic benefits of the cartridge 44 while decreasing the space required by the cartridge 44 inside the machine 20. Multiple safeguards have been designed into this rotating shutter mechanism to prevent a catastrophic toner dump.

Turning now to FIGS. 13–18 the operation of the locking mechanism for a refillable CRU 44 will be discussed. Looking first at FIG. 13, the bottom of the CRU 44 is illustrated including the locking flange 116 attached thereto. The locking mechanism for the CRU 44 comprises a rail member 118 having a plurality of short protrusions 119 that ride along a corresponding rail 122 located on the machine chassis. The protrusions are essentially equal except for one locking protrusion 120 which acts as the stop/locking member for the refill position of the CRU 44. This locking member cooperates with a stop member 124 located on the machine chassis. The rail portion 116 of the CRU 44 and the locking tab of the machine chassis are illustrated in detail in FIGS. 14 and 15. Turning next to FIGS. 16 through 18, the general operation of the initial insertion and the refill of the CRU 44 is illustrated. In FIG. 16 it can be seen that the CRU 44 is inserted at an angle so that the protrusion 120 slides past the stop member 124 of the machine chassis. In the refill position the CRU 44 is slid out of the machine in the direction of arrow 125 until the protrusion 120 contacts the stop member 124 on the machine chassis which prevents the CRU 44 from being totally removed from the machine and also provides the proper support for the CRU 44 so that it can be refilled without damage. Once the refill is complete, the CRU 44 is then reinserted back into the machine in the direction of arrow 127 as illustrated in FIG. 18. When the CRU 44 is at its end of life, the CRU 44 is slid out until the protrusion 120 contacts stop member 124 and the extending area of the CRU is then lifted so that the protrusion 120 clears the stop member 124 and allows removal of the CRU 44.

This locking scheme provides a generally foolproof system for allowing a CRU 44 to be refilled with toner and extend the life of the CRU 44 beyond that which can be obtained with a simple, one-time, non-refillable CRU 44. The combination of the toner bottle 150 having a keying portion and a valve mechanism 156 also allows generally clean refilling of the CRU 44 thus enabling the machine to be quite simply refilled by a relatively inexperienced operator.

In recapitulation, there is provided a container for delivering a supply of particles for use in a developer unit of an electrophotographic printing machine, the container being fittable to an adapter associated with the developer unit, the container includes a body defining a chamber for storing particles therein, the body defining an aperture in an end thereof and a cover for use in covering the aperture, wherein the cover comprises a valve mechanism and a keying feature, wherein the keying feature cooperates with a portion of the developer unit so that upon rotation of the container, the valve mechanism is actuated.

It is, therefore, apparent that there has been provided in accordance with the present invention, an all-in-one process cartridge and strategy that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

We claim:

1. A container for delivering a supply of particles for use in a developer unit of an electrophotographic printing machine, the container being fittable to an adapter associated with the developer unit, the container comprising:

a body defining a chamber for storing particles therein, said body defining an aperture in an end thereof;

a cover for use in covering the aperture, wherein said cover comprises a valve mechanism and a keying feature, wherein said keying feature cooperates with a valve portion of the developer unit so that upon partial rotation of the container, said valve mechanism is actuated and upon further rotation of said container said valve portion of the developer unit is opened to allow toner to flow from the container to the developer unit.

2. A container according to claim 1, wherein said keying feature comprises a plurality of protrusions that cooperate with a corresponding plurality of apertures in the developer unit to temporarily lock the container to the developer unit.

3. A container according to claim 1, wherein said body comprises a generally cylindrical portion having a narrowed neck at the end thereof defining the aperture.

4. A container according to claim 2, wherein said plurality of protrusions include a first plurality of protrusions extending in a direction generally axially from said body and a second protrusion extending generally radially from said body.

5. A container according to claim 4, wherein said first plurality of protrusions comprise a distinct visual indicia.

6. A container according to claim 5, wherein said distinct visual indicia comprises a proprietary indicia of source.

* * * * *